US008100717B2

(12) United States Patent
Amidon

(10) Patent No.: US 8,100,717 B2
(45) Date of Patent: Jan. 24, 2012

(54) CONNECTOR WITH INTEGRAL SEAL

(75) Inventor: Jeremy Amidon, Marcellus, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/943,681

(22) Filed: Nov. 10, 2010

(65) Prior Publication Data

US 2011/0059651 A1 Mar. 10, 2011

Related U.S. Application Data

(63) Continuation of application No. 12/496,187, filed on Jul. 1, 2009, now Pat. No. 7,845,980.

(51) Int. Cl.
*H01R 13/40* (2006.01)

(52) U.S. Cl. ..... 439/587; 439/578

(58) Field of Classification Search ..... 439/578, 439/587, 271, 278, 279, 281
See application file for complete search history.

(56) References Cited

U.S. PATENT DOCUMENTS

| | | | | |
|---|---|---|---|---|
| 1,871,397 | A * | 8/1932 | Watts | 439/281 |
| 4,447,103 | A | 5/1984 | Werth et al. | |
| 4,583,811 | A | 4/1986 | McMills | |
| 4,595,251 | A | 6/1986 | Moulin | |
| 4,648,672 | A | 3/1987 | Kobler | |
| 5,456,614 | A | 10/1995 | Szegda | |
| 5,571,028 | A | 11/1996 | Szegda | |
| 5,857,865 | A | 1/1999 | Shimirak et al. | |
| 6,045,383 | A | 4/2000 | Fujiwara | |
| 7,278,882 | B1 * | 10/2007 | Li | 439/578 |
| 7,300,309 | B2 | 11/2007 | Montena | |
| 7,393,245 | B2 | 7/2008 | Palinkas et al. | |
| 7,845,980 | B1 | 12/2010 | Amidon | |
| 2005/0029807 | A1 | 2/2005 | Montena | |
| 2008/0113554 | A1 | 5/2008 | Montena | |
| 2008/0220647 | A1 | 9/2008 | Mathews | |

OTHER PUBLICATIONS

PCT/US2010/040372; International Filing Date: Jun. 29, 2010. International Search Report and Written Opinion and Notification of Transmittal. Mailed date: Feb. 8, 2011. 8 pages.

* cited by examiner

*Primary Examiner* — Tho D Ta
(74) *Attorney, Agent, or Firm* — Schmeiser Olsen & Watts

(57) ABSTRACT

A connector is provided comprising a tubular connector body with a mating end, an end face at the mating end, an outer diameter, and a center axis. A circular groove in the end face defines a ring with a sealing surface, and a coupling member mates with the sealing surface. The coupling member has a mating end configured to connect with a separate device.

15 Claims, 2 Drawing Sheets

CONNECTOR WITH INTEGRAL SEAL

CROSS REFERENCE TO RELATED APPLICATIONS

This application is a continuation of U.S. patent application Ser. No. 12/496,187, filed Jul. 1, 2009 and titled "Connector with Integral Seal". This application claims priority from, and incorporates by reference the entirety of, U.S. patent application Ser. No. 12/496,187.

BACKGROUND OF THE INVENTION

This invention relates generally to a cable connector having a coupling member to connect it to other connectors, equipment ports, or the like. Specifically, this invention relates to an improved sealing arrangement for preventing moisture from penetrating at a joint between the coupling member and the body of the connector.

Cable telecommunication systems have evolved and flourished to provide many cable telecommunication services, such as digital television programming, voice over internet protocol (VOIP) services, broadband internet, and pay-per-view ordering/billing/monitoring. With the growing population and the growing demand for cable telecommunication services, cable telecommunication systems have continually expanded since their inception in the 1940's. Today, cable telecommunication services are delivered to millions of users (e.g. at residential or commercial premises) by feeder cables running from head ends. A head end receives and retransmits video and other signals over a local cable infrastructure along feeder cables, which branch off to individual user's facilities along drop cables. These drop cables can be further divided to distribute signals along distribution cables on a user's facility to multiple end devices, such as televisions or modems.

As can be envisioned from the above description, cable does not run as a single length from a head end to each and every end device. In routing the feeder cables, drop cables, and distribution cables to feed the signals to all the users in a local cable infrastructure, multiple lengths of each cable type (e.g. feeder cable, drop cable, distribution cable) are necessary. Cable connectors can join one length of one type of cable to another length of the same type of cable in order to form a consistent signal path with consistent signal qualities. In the case of coaxial cables, which are currently used to feed and distribute telecommunication signals, the signals are in the form of alternating electrical current, so coaxial cable connectors connecting two lengths of the same cable are designed and used to pass a consistent alternating electrical current without altering the electrical characteristics.

Alternatively, one length of one type of cable can be joined by a coaxial cable connector to another length of another type. Further, a cable can be connected to an end device or other intermediate device by a cable connector.

In order to accommodate the various combinations of connection, including connections between the variously sized cables with various electrical characteristics, a large variety of cable connectors exist. These connectors are used extensively, and more and more as the cable telecommunication systems continue to develop and grow. A large percentage of these cable connectors are used outside, while another percentage of them are used inside a residential, commercial, or industrial property. Many are located underground, connecting underground cables, while some are exposed to the air.

Both indoors and outdoors, the cable connectors are subject to environmental hazards and weathering elements, such as damage from exterior matter, including water. In particular, especially with cable connectors used outdoors, water poses a significant threat of damage. Some forms of water include, but are not limited to, rain, condensation, high relative humidity, and flooding. Even indoors, connectors are exposed to water, especially in basements, where they are frequently used. When water gets inside a connector, it can cause significant and costly damage. In particular, water can catalyze corrosion. Corroded parts can negatively affect the electrical characteristics of the cable connector, which can negatively alter signals carried along conductors therein. Water itself in a connector, even without corrosion occurring, can negatively affect the electrical signal characteristics too. A short to ground from the conductor might occur, thereby stopping the signal from reaching its destination altogether. Any malfunction or degradation of the connector requires maintenance, as even minor signal alteration can cause major problems, for example, with the viewing of a video image. Alteration, or loss of desirable signals can cause some form of disruption in the telecommunication services provided to a user. For instance, television programming images can be distorted, broken, or choppy, while internet connections can be slowed or transmissions lost, and VOIP services can be slowed, rendered inaudible, or lost. Furthermore, minor losses in signals returning or sent from user facilities build up in cable telecommunication systems to reduce overall signal to noise ratios. To prevent this buildup of signal loss, connectors must be maintained and repaired. Maintenance is costly. The problems must be diagnosed. Once identified as a connector issue, connectors must be accessed and repaired, often by digging to expose them, or by accessing them on or in a user's facility. Prolonging the life of connectors by avoiding water damage can save time and money.

Cable connectors connect, or mate, with other mating connectors in various ways. Some connections are fairly static. For instance, a male cable connector might merely plug directly into a female version of the cable connector with no moving parts attached to either connector. Other connectors might have a coupling member that rotates in some way, allowing the attached cables to resist rotation. For instance, a male connector might have an externally threaded coupling member which screws into an internally threaded female member; or the female connector might have internal threads that screw onto a male version of the cable connector. In this second type of connector, at least one coupling member of either the male or female connector must be able to freely rotate but still be attached to the connector. This feature creates a joint between the coupling member and the body of the connector. When the coupling member is screwed tight in connection to another connector, the coupling member is also pulled tightly against the connector to which it is attached. The friction between the coupling member and connector affects the coupling member's ability to freely rotate.

Such a joint creates an opportunity for water intrusion. A potential water hazard is greater at a moveable joint than a stationary joint because it can be more difficult to maintain a seal at the moveable joint. The extra motion provides greater opportunity for damage to the seal. The coupling member also may not be fully engaged and tightened, or it can loosen, thereby leaving extra space for water to enter. Moving parts also can wear the joint and any seal between them, creating an extra need for durability. Non-durable parts at the joint might wear quickly, degrading the seal and providing water a greater opportunity to enter.

The prior art is generally cognizant of sealing exposed joints where water can intrude. At the rotatable joint between a coupling member and a connector body, one typical sealing solution employs an o-ring. A groove either inside the coupling member or outside the connector body typically retains the o-ring. When the coupling member is secured onto and around the connector body, the o-ring fits snugly between the two parts, providing a seal.

Another typical solution involves the use of a sleeve. One type of sleeve is slipped on a first connector. When a second connector is mated to the first, the sleeve either covers the connection, or can be repositioned to cover the connection between the two mated connectors. This type of sleeve does not protect the joint between the connector body and the coupling member. Another type of sleeve is slipped onto a coaxial cable. From there, it is able to be repositioned to cover the end connector attached to the coaxial cable, as well as a second connector mated to the first connector.

These solutions require additional parts that can pose manufacturing difficulties and expense. Furthermore, separate o-rings and sleeves are sometimes handled or installed improperly causing the seals to function unreliably or ineffectively. For example, an o-ring might be out of its proper position when the installer secures the connection. In this case, the o-ring does not seal properly, and it might become damaged. Sliding a sleeve over the outside of a connector can cause tears or abrasions. The sleeve might again not be positioned properly over the intended area of protection. Otherwise, the sleeve might bunch or fold, preventing it from fitting tightly and sealing on the connector surface. Still other times, cable installers do not use the seals at all when installing the connectors. Each of these cases results in the undesirable case of a connector that is water-penetrable.

It would be advantageous to seal the joint between the coupling member and connector body without requiring additional assembly steps, without requiring additional parts, and without relying solely on cable installers to properly install connector seals.

SUMMARY OF THE INVENTION

In one embodiment of the invention, a connector is provided comprising a tubular connector body with a mating end, an end face at the mating end, an outer diameter, and a center axis. A circular groove in the end face defines a ring with a sealing surface, and a coupling member mates with the sealing surface. The coupling member has a mating end configured to connect with a separate device.

DETAILED DESCRIPTION OF THE INVENTION

To simplify the description of the invention as illustrated in the embodiments depicted herein, some potential connector components that are not pertinent to the present invention are not illustrated in the FIGS. Furthermore, only one end of a connector is shown. Those skilled in the art are aware that there exists a variety of connector configurations, and that the invention disclosed herein is not limited to the particular configuration illustrated in the FIGS.

Figure 1:
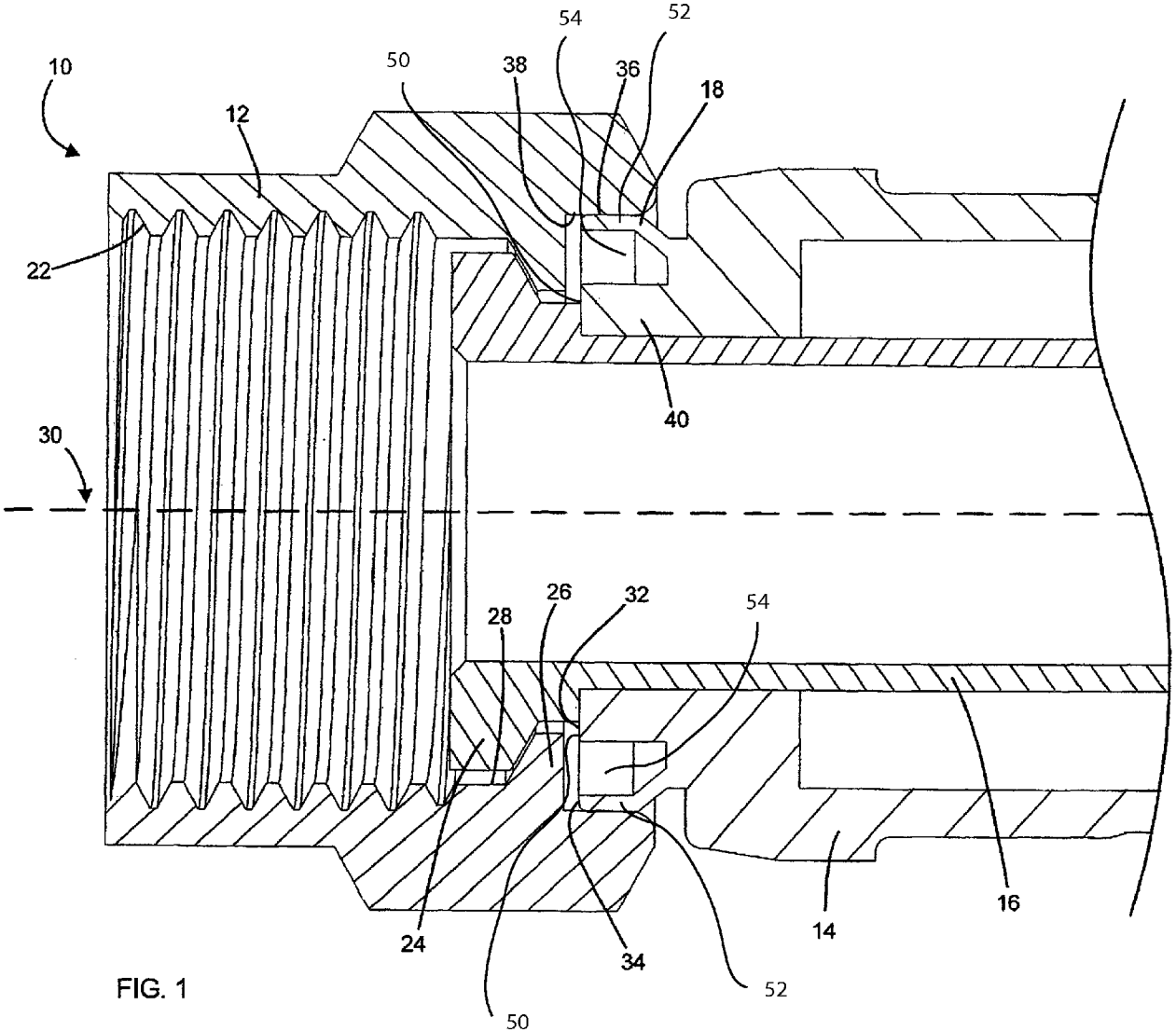
FIG. 1 is a sectional view showing the mating end of a connector and the seal according to one embodiment of the invention.

With reference to FIG. 1, a mating end of a coaxial cable end connector 10 is shown. The end connector 10 has a connector body 14 and post 16. The connector body 14 and post 16 are generally tubular or cylindrical in shape. The connector body 14 and post 16 each have a mating end interfacing with and/or supporting a rotatable coupling member 12. The coupling member 12 extends over the connector body 14 and/or the tubular post 16 to create an overlap. The length of this overlapping portion can vary as the coupling member 12 can extend up to and beyond the full length of the connector body 14. The coupling member 12 shown is a mating nut, with a threaded section 22 configured to rotatably engage with a threaded section (not shown) on another connector or another device (not shown). The mating nut could alternatively be another type of coupling.

The post 16 secures the coupling member 12 to the connector 10. The mating end of the post 16 is flared, or otherwise has an enlarged diameter at a retaining portion 24. The coupling member 12 has a corresponding protrusion extending from the inner diameter 28 of the coupling member 12 toward its center axis 30. The retaining portion 24 of the post 16 and the protrusion 26 of the coupling member 12 together secure the coupling member 12 onto the connector 10. When the coupling member 12 is screwed tightly with a mating connector, the protrusion 26 can pull tightly against the retaining portion 24, thereby increasing the frictional force there between, and locking the coupling member 12 from further rotating. From the retaining portion 24 at its mating end, the post 16 extends into, and in portions, can mate with the connector body 14.

The connector body 14 can include a seal base 40 at its mating end or at a portion of the connector body 14 near the overlapping portion of the coupling member 12. A sealing portion 18 is integral with and extends from the seal base 40. Being integral means the sealing portion 18 and seal base 40 are one piece, rather than two separate pieces or two pieces attached or joined. The seal base 40 can be integral with the connector body 14 as well, forming a noticeable protrusion from the connector body 14, or remaining a uniform portion of the connector body 14. When the seal base 40 is integral with the connector body 14, because the seal base 40 is part of the connector body 14, the sealing portion 18 extends from and/or is integral with either the seal base 40 or the connector body 14. In an alternate embodiment, the seal base 40 is a separate component from the connector body 14, positioned adjacent to, or attached to, the connector body 14 on the connector body's mating end or on its circumference. Similarly, the sealing portion 18 can be attached to the seal base 40. Either the seal base 40 or the sealing portion 18 can be attached by known methods, including but not limited to, welding, bolting, screwing, and gluing. Manufacturing the sealing portion 18 and/or seal base 40 separately from the connector body 14 might be less expensive in certain embodiments. Furthermore, stronger compressive forces might be achievable.

The connector body 14 is positioned exterior to the post 16, so it provides an exterior intersection with the coupling member 12. The intersection is exterior because it is exposed to the surrounding environment, and is a place for first entry of water. A seal at this exterior intersection seals water or debris out of a joint or annular gap between the connector body 14 and coupling member 12, as well as any inner joints or annular gaps between the connector body 14 and post 16, and between the post 16 and coupling member 12. Furthermore, at this location, the sealing portion 18 can be machined or otherwise built integrally as a single piece with the seal base 40. For instance, the sealing portion 18 can be formed by cutting a circular groove 54 into the end face 50 of the connector body, thereby creating a ring 52 and a sealing surface. Furthermore, the ring 52 can be offset toward the center axis 30 from the maximum diameter of the connector body 14, defining a void between the ring 52 and the maximum diameter of the connector body 14. This void can be created by removing a section of the connector body 14, or by fashioning the connector body 14 more narrowly.

The sealing portion 18 can extend from around the circumference of the seal base 40 from or near the mating end of the connector body 14, toward the mating end of the connector 10. Alternatively, in the case when the coupling member 12 extends over a greater length of the connector body 14, creating a more significant overlap between the coupling member 12 and the connector body 14, the sealing portion 18 can extend from around the circumference of the seal base 40 at another exterior portion of the connector body 14 near the overlapping portion of the coupling member 12. The sealing portion 18 can also extend away from the mating end of the connector 10.

The seal width of the sealing portion 18 is defined by the distance from its heel where it connects to the connector body 14, and an end edge 34. The seal width can vary. When no force is applied to the sealing portion 18, it can be shaped generally like an elongated ring or a segment of a hollow cone with a diameter telescoping out as it extends from the heel. The sealing portion 18 can also include one or more bends toward the center axis 30. The sealing portion 18 can have a first sealing surface 36 that contacts a second sealing surface 38, the latter being on the coupling member 12. The second sealing surface 38 can be an annular inner wall or surface at the rear end of the coupling member 12 or at any portion where the coupling member 12 overlaps the connector body 14. Such an annular inner wall can be created, for instance, by a bore. The sealing portion 18 presses the first sealing surface 36 outwardly from the center axis 30 against this annular inner surface that constitutes the second sealing surface 38. The sealing portion 18 at the first sealing surface 36 is manufactured with a free diameter larger than the diameter of the second sealing surface 38 against which it mates. The free diameter is the diameter of the sealing portion 18 when no force acts on it. With a thin, elastically deformable construction, the sealing portion 18 flexes to allow at least a slight compression fit. The second sealing surface 38 compresses the first sealing surface 36 from its free diameter to a smaller operating diameter. The elastic deformation of the sealing portion 18 maintains the compressive force and seal while allowing the coupling member 12 to rotate. The sealing portion 18 can be plastic or another elastically deformable material providing the appropriate friction and tension. For instance, acetal is an appropriate material, at least in one instance, with a yield strength of approximately 83 MPa (12,000 PSI). The yield strength indicates the amount of tension to which the material can be subjected before it plastically deforms and fails to return to its original size. The appropriate friction will be low, so that the coupling member 12, given the tension, will easily move with respect to the sealing portion 18 and connector body 14. Generally, the friction should be as low as possible to reduce wear and maintain the permissible tension. Some acetals, for instance, have dynamic coefficients of friction ranging as low as 0.4 to 0.1 when in dry contact with other acetal or steel. The use of a lubricant, such as natural oil, synthetic oil, or grease, will lower the coefficient of friction. Other potentially suitable materials include, but are not limited to, polyurethane, nitrile rubber, highly saturated nitrile rubber, flouroelastomer, ethylene propylene diene M-class (EPDM) rubber, silicone rubber, polytetraflouroethylene, polyoxymethylene, polyacetal, acetal homopolymer, acetal copolymer, polyacrylate, polystyrene, polyvinyl chloride, polyethylene, polycarbonate, and polychloroprene. One skilled in the art would recognize appropriate materials.

The thickness of the sealing portion 18 can vary as appropriate to maintain proper elasticity or flexibility. The sealing portion 18 can be thick enough to prevent unwanted seal distortion, but not so thick as to compromise elasticity. As the thickness is increased, the sealing portion 18 will become more rigid and less elastic. The elasticity of the sealing portion 18 helps maintain the contact between the first sealing surface 36 and the second sealing surface 38. Also, in the uncompressed state, the first sealing surface 36 can be angled at various degrees in relation to the second sealing surface 38 so that in the compressed state, a proper sealing contact with the coupling member 12 is established. The angle is such that the seal extends radially from the center axis 30 when the second sealing surface is parallel to the center axis 30. When the seal is compressed, it elastically flexes toward the center axis 30. A larger contact area can be created, and a greater compressive force can be achieved. As an example, a more rigid sealing portion 18 might be angled closer to parallel with the second sealing surface 38 than a more elastic sealing portion 18. As the more rigid sealing portion 18 is compressed against the second sealing surface 38, it will flex less. Accordingly, angling the more rigid sealing portion 18 closer to parallel than the more elastic sealing portion 18 creates a larger contact area between the first sealing surface 36 and second sealing surface 38.

The appropriate angle, force, flexibility, and surface area to achieve a good sealing contact can be adjusted by including one or more bends in the integral sealing portion 18. These bends can be directed toward the center axis 30. Also, bending the end toward the center axis 30 can allow the coupling member 12 to slide over and onto the sealing portion 18 during assembly, when the sealing portion has a greater maximum diameter than the coupling member 12. Furthermore, while the first sealing surface 36 can be flat or planar, it can also have a creased bend or curved bend toward the center axis 30 to create a lip. The lip is a point of contact or first point of contact with the second sealing surface 38. The lip width is the distance from the heel of the sealing portion 18 to the lip.

Figure 2:
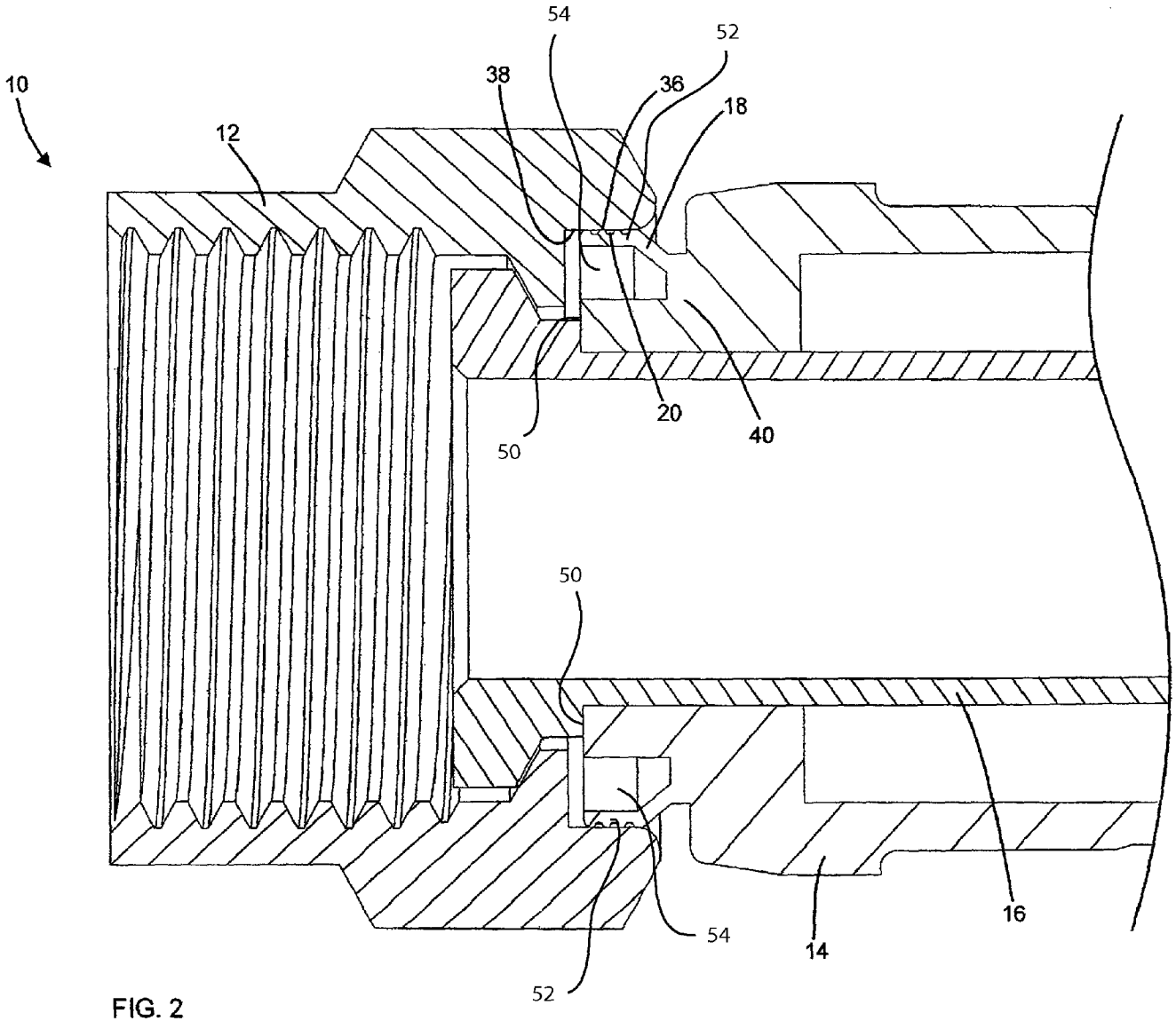
FIG. 2 is a sectional view showing the mating end of a connector and the seal according to one alternate embodiment of the invention.

In one embodiment, illustrated in FIG. 2, the sealing portion 18 has a structural pattern 20 in order to enhance or assist in sealing. The pattern can be raises or reliefs, such as grooves, ridges, valleys or another similar pattern to provide separate, smooth points of contact between the sealing portion 18 and the coupling member 12. The points of contact are smooth to reduce friction, and each point makes contact to provide a seal at each point. Having separate points of contact focuses the compressive force over a smaller surface area, thereby generating a higher sealing force. Additionally, the relief pattern 20 can aid sealing by catching debris that might otherwise get caught between two sealing surfaces with no relief pattern. In the latter case, the debris causes a poor seal. However, when the debris falls into the grooves, ridges, valleys, etc., the raised points on the first sealing surface 36 are free to make clear contact with the second sealing surface 38. The relief pattern 20 can also provide reservoirs for a lubricant, which enhances or assists sealing by decreasing wear on the first sealing surface 36 and second sealing surface 38. Lubrication placed on the first sealing surface 36 and/or portions of the raised or relief pattern 20 can allow greater compressive forces without increasing resistance during rotation of the coupling member 12.

What is claimed is:

1. A connector comprising:

a tubular connector body with a mating end, an end face at said mating end, an outer diameter, and a center axis, said end face being generally perpendicular to said center axis;

a circular groove within said end face defining a ring with a sealing surface, said ring located radially outward from said circular groove; and a coupling member mating with said sealing surface, said coupling member having a threaded section configured to connect with a separate device.

2. The connector of claim 1, further comprising a void in said tubular connector body at an intersection of said outer diameter and said end face.

3. The connector of claim 1, wherein said ring extends outward from said center axis to help establish a proper sealing contact.

4. The connector of claim 1, wherein said ring further comprises a compressed state and an uncompressed state, and at least one bend toward said center axis in said uncompressed state.

5. The connector of claim 1, wherein said ring is elastically deformable such that compressive force can be applied to said seal while connecting said coupling member to said separate device and disconnecting said coupling member from said separate device without permanently deforming the shape of said seal.

6. A connector comprising:

a tubular connector body with a mating end, an end face at said mating end, an outer diameter, and a center axis, said end face being generally perpendicular to said center axis;

a circular groove within said end face defining a ring with a sealing surface, said ring located radially outward from said circular groove, said sealing surface defining an annular outer wall of the ring; and a coupling member having an annular inner wall mating with said sealing surface, the sealing surface having a diameter larger than a diameter of the annular inner wall, the ring compressing such that the sealing surface flexes into the circular groove to allow a compression fit within the annular inner wall of the coupling member, said coupling member having a mating end configured to connect with a separate device.

7. The connector of claim 6, further comprising a void in said tubular connector body at an intersection of said outer diameter and said end face.

8. The connector of claim 6, wherein said ring extends outward from said center axis to help establish a proper sealing contact.

9. The connector of claim 6, wherein said ring further comprises a compressed state and an uncompressed state, and at least one bend toward said center axis in said uncompressed state.

10. The connector of claim 6, wherein said ring is elastically deformable such that compressive force can be applied to said seal while connecting said coupling member to said separate device and disconnecting said coupling member from said separate device without permanently deforming the shape of said seal.

11. A connector comprising:

a tubular connector body with a mating end, an end face at said mating end, an outer diameter, and a center axis, said end face being generally perpendicular to said center axis;

a circular groove within said end face defining a ring with a sealing surface, said ring located radially outward from said circular groove; and a coupling member mating with said sealing surface such that no portion of the coupling member is located within the circular groove, said coupling member having a mating end configured to connect with a separate device.

12. The connector of claim 11, further comprising a void in said tubular connector body at an intersection of said outer diameter and said end face.

13. The connector of claim 11, wherein said ring extends outward from said center axis to help establish a proper sealing contact.

14. The connector of claim 11, wherein said ring further comprises a compressed state and an uncompressed state, and at least one bend toward said center axis in said uncompressed state.

15. The connector of claim 11, wherein said ring is elastically deformable such that compressive force can be applied to said seal while connecting said coupling member to said separate device and disconnecting said coupling member from said separate device without permanently deforming the shape of said seal.

* * * * *